United States Patent [19]

Chiang

[11] Patent Number: 4,828,270

[45] Date of Patent: May 9, 1989

[54] BALL GAME DEVICE

[76] Inventor: Hsi-Shih Chiang, 8-1, 4th Fl., Lane 77, Sung Chiang Road, Taipei, Taiwan

[21] Appl. No.: 211,532

[22] Filed: Jun. 24, 1988

[30] Foreign Application Priority Data

May 12, 1988 [TW] Taiwan ..... 77204430

[51] Int. Cl.[4] ..... A63B 63/02

[52] U.S. Cl. ..... 273/401; 273/402

[58] Field of Search ..... 273/398–402, 273/396, 397

[56] References Cited

U.S. PATENT DOCUMENTS

| | | | |
|---|---|---|---|
| 613,383 | 11/1898 | Morgan | 273/402 |
| 642,903 | 2/1900 | Hachmuth | 273/401 |
| 1,371,867 | 3/1921 | Dean | 273/397 |
| 2,021,989 | 11/1935 | DeMaster | 273/401 |
| 2,647,747 | 8/1953 | Kenney et al. | 273/402 |
| 3,880,427 | 4/1975 | Bingham | 273/402 X |

FOREIGN PATENT DOCUMENTS

| | | | |
|---|---|---|---|
| 573188 | 3/1924 | France | 273/400 |
| 2572945 | 5/1986 | France | 273/400 |

*Primary Examiner*—Paul E. Shapiro

*Attorney, Agent, or Firm*—Townsend & Townsend

[57] ABSTRACT

The present invention provides a ball shooting game device for children which comprises a vertical panel having a through-hole, a guide member extending rearward from the periphery of the vertical panel, and a basket having a net and a mounting looped frame attached to the vertical panel below the through-hole at the rear side. The device further has a hanging cord used for hanging the device on a wall so that children can play with the device indoors.

7 Claims, 3 Drawing Sheets

BALL GAME DEVICE

BACKGROUND OF THE INVENTION

This invention relates to a game device and particularly to a ball game device for children having a basket for receiving balls.

An object of the invention is to provide a game device which can be played by children as a basket ball game.

Another object of the invention is to provide a game device which can be played by children to throw a ball into the receiving basket like a baseball game player.

Another object of the invention is to provide a game device by which children can achieve an athletic training and health benefits.

Still another object of the invention is to provide a ball game device for children that can be played indoors and installed on a wall of a room.

SUMMARY OF THE INVENTION

The present invention provides a ball game device which comprises a vertical panel having a through-hole, a guide member extending rearward from the periphery of the vertical panel, and a basket having a net and a mounting looped frame attached to the vertical panel below the through-hole at the rear side. Preferably, the vertical panel and the guide member are of an integrally molded plastic piece.

The vertical panel further has a bracket bar formed at the rear side thereof below the through-hole for supporting one side of a looped frame of the basket, a clamping plate member formed on the vertical panel just above the bracket bar to clamp the one side of the looped frame between the bracket bar and the clamping plate member, and engaging means formed at the rear side of the panel to engage with the engaging means of the looped frame.

The present exemplary embodiment will be described in detail with reference to the accompanying drawings, in which:

DETAILED DESCRIPTION OF THE PREFERRED EMBODIMENT

Figure 1:
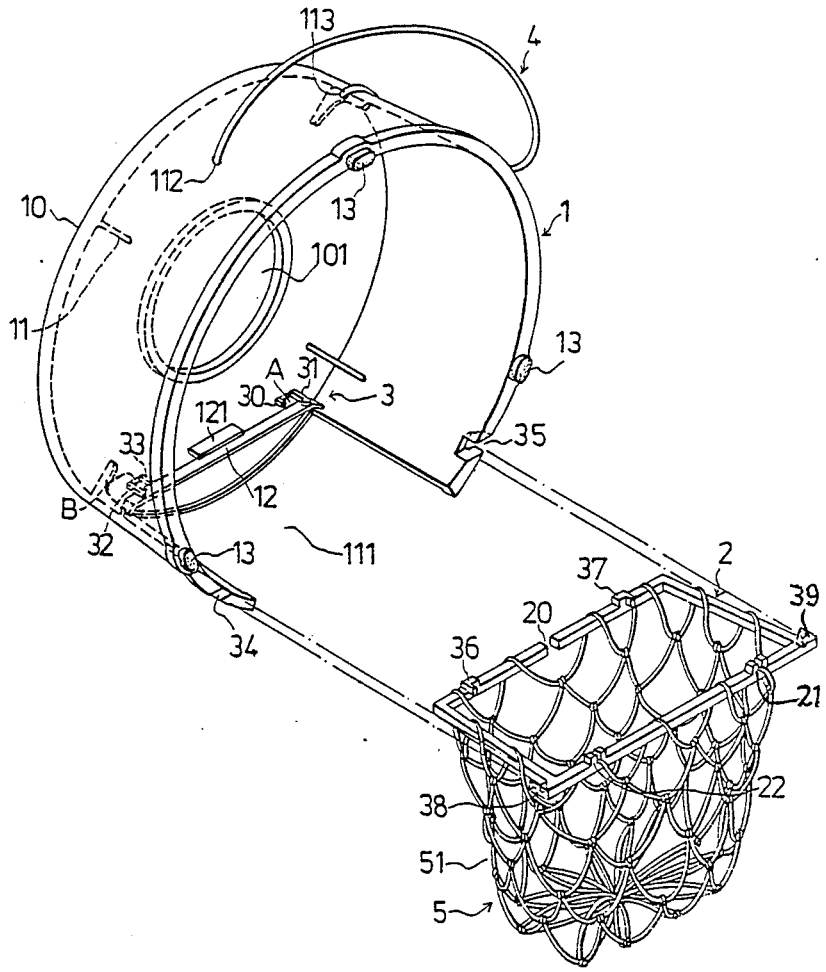
FIG. 1 is a exploded view of a game device according to the present invention.
Figure 2:
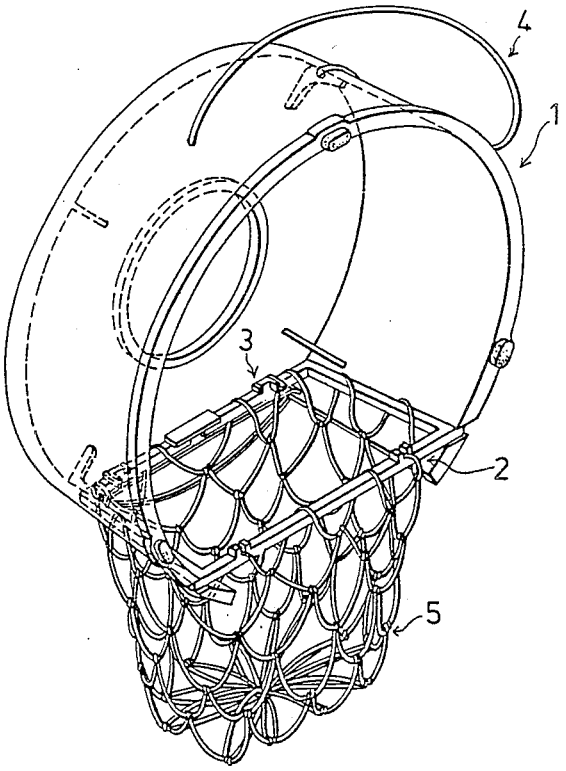
FIG. 2 is a perspective view of the game device of FIG. 1.
Figure 3:
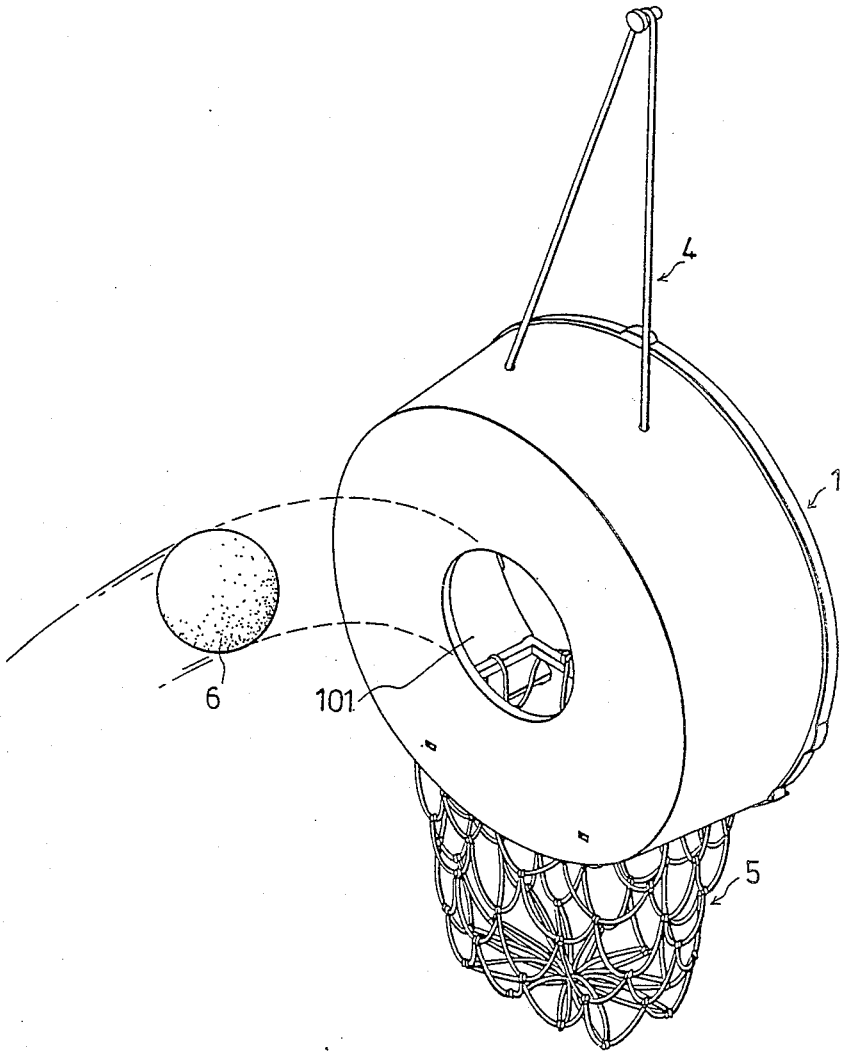
FIG. 3 is a perspective view of the game device of FIG. 1 in another position.

Referring to the drawings, a ball game device embodying the present invention is shown, having a vertical panel 10 which is substantially circular and has a through-hole 101. Below the through-hole 101 are a bracket bar 12 and a clamping member 121 formed integrally with the rear side of the vertical panel 10. A pair of engaging members 30 and 31 are formed at one end of the bracket bar 12 to confine a space A. Another pair of engaging members 32 and 33 are formed at another end of the bracket bar 12 to confine a space B.

The vertical panel 10 further has an integrally formed curved guide member 1 which extends rearward from the periphery thereof and is reinforced by ribs 11. To hang the ball game device on a wall, a hanging cord 4 is attached to the guide member 1 by being threaded through holes 112 and 113 of the guide member. On the edge of the guide member 1 are provided cushioning pads 13 to minimize the impact of the guide member 1 on the wall. The guide member 1 extends upward from one end of the bar 12 and downward to the other end of the bar 12.

A basket 5 is attached to the rear side of the vertical panel 10 below the guide member 1. The basket 5 has a net 51 attached to a rectangularly looped frame 2. The looped frame 2 has a discontinuation 20 through which the net 51 can be attached thereto, positioning means 21 and 22 for the net 51, and two engaging members 36 and 37 to respectively engage in the space B of the engaging members 32 and 33 and the space A of the engaging members 30 and 31. Both the engaging members 31 and 32 are formed into a hook. When one side of the looped frame 2 is inserted between the bracket bar 12 and the clamping member 121, the engaging members 36 and 37 engage firmly with the engaging members 32 and 31 respectively, and projections 38 and 39 of the looped frame 2 engage in notches 34 and 35 of the guide member 1, thereby securing the basket 5 to the vertical panel 10.

In operation, children may shoot foamed balls or the like into the basket 5 through the through-hole 101 of the vertical panel 10.

With the invention thus explained, it is apparent that numerous modifications and variations can be made without departing from the scope of the invention. It is therefore intended that the invention be limited as indicated only in the appended claims.

What I claim is:

1. A ball game device comprising:

a vertical panel having a through-hole, a front side and a rear side:

a basket having a net and a mounting looped frame lying in a horizontal plane for holding said nat, said looped frame having one side attached to said vertical panel and two opposite sides adjacent to two ends of said one side of said looped frame; and a guide member attached to said vertical panel at said rear side and projecting rearward from said vertical panel, said guide member extending upward to a location above said through-hole from one of said opposite sides of said looped frame and then extending downward to the other of said opposite sides of said looped frame.

2. A ball game device as claimed in claim 1, further comprising a hanging cord attached to said guide member.

3. A ball game device as claimed in claim 1, wherein said vertical panel and said guide member are of an integrally molded plastic piece.

4. A ball game device as claimed in claim 1, wherein said vertical panel is a substantially circular panel and said guide member is an arc-shaped plate member extending along the periphery of said vertical panel.

5. A ball game device as claimed in claim 4, wherein said looped frame of said basket is substantially rectangular, said looped frame having engaging means thereon.

6. A ball game device as claimed in claim 5, wherein said vertical panel further has a bracket bar formed at said rear side below said through-hole for supporting one side of said looped frame, a clamping plate member formed on said vertical panel just above said bracket bar to clamp said one side of said looped frame, and engaging means formed at said rear side to engage with said engaging means of said looped frame.

7. A ball game device as claimed in claim 6, wherein said looped frame further includes engaging projections at said opposite sides, and said guide member is provided with notches to engage with said engaging projections.

* * * * *